United States Patent [19]

Daniels

[11] 4,268,955

[45] May 26, 1981

[54] CONTACT INSERTION AND REMOVAL TOOL

[75] Inventor: William A. Daniels, Birmingham, Mich.

[73] Assignee: Daniels Manufacturing Corp., Bloomfield Hills, Mich.

[21] Appl. No.: 22,908

[22] Filed: Mar. 22, 1979

Related U.S. Application Data

[63] Continuation of Ser. No. 835,057, Sep. 21, 1977, abandoned.

[51] Int. Cl.[3] ..... H01R 43/00

[52] U.S. Cl. ..... 29/747; 29/758; 29/764; 81/355; 81/DIG. 6; 294/103 R

[58] Field of Search ..... 29/747, 764, 758, 739, 29/741; 294/103; 81/355, 423, DIG. 6

[56] References Cited

U.S. PATENT DOCUMENTS

| | | | |
|---|---|---|---|
| 389,195 | 9/1888 | Charpentier | 294/103 R |
| 1,258,016 | 3/1918 | Kepner | 294/103 R |
| 2,099,588 | 11/1937 | Annema | 294/103 R |
| 2,317,688 | 4/1943 | McDonald | 294/103 R |
| 3,538,585 | 11/1970 | Hendry et al. | 29/747 X |
| 3,676,912 | 7/1972 | Anhalt et al. | 294/747 |
| 3,903,577 | 9/1975 | Phillips | 29/764 |

*Primary Examiner*—Carl E. Hall

*Attorney, Agent, or Firm*—Harness, Dickey & Pierce

[57] ABSTRACT

A manually operable tool for inserting or removing contacts into or from electrical connectors, having an elongated handle housing with a spring-loaded longitudinally slidable member therein, the forward extremities of both the slidable member and handle housing having jaws in opposed parallel relation to each other, and operable to hold a contact under spring pressure or to release the contact when the slidable member is moved rearwardly.

10 Claims, 10 Drawing Figures

CONTACT INSERTION AND REMOVAL TOOL

This is a continuation, of application Ser. No. 835,057, filed Sept. 21, 1977, now abandoned.

BACKGROUND OF THE INVENTION

The field of the present invention relates to hand tools used to handle electrical contacts, both pin insert contacts and socket insert contacts having wire crimped or soldered thereto; and is particularly useful for inserting or removing contacts into or from conventional electrical connectors commonly employed in aircraft and other electrical systems because of their reliability and space saving characteristics. These electrical connectors are characterized in part by the use of a flexible gasket protecting the contacts from weather and the use of resilient fingers which engage shoulders on the contacts to positively lock them in the connectors. Because of the small size of most such connectors, the use of flexible gaskets and resilient fingers mandates the special tools be employed to insert or remove contacts therefrom. An example of a tool for this purpose is disclosed in Military Standard MS27495 (USAF) which sets forth a hand tool based on a tweezer design of the normally closed type. Tools made in accordance with this Military Standard are well known in the art.

Of course, tweezers, wrenches and other tools designed with jaws to grip various materials are also disclosed in the prior art. For example, U.S. Pat. No. 1,559,657, Nov. 3, 1925 to Todd discloses a hand-operated violin sound post setter; U.S. Pat. No. 3,342,090, Sept. 19, 1967 to Martin discloses a hand-held tool into which a nut may be quickly and securely interfitted to facilitate the insertion and tightening of a bolt therein; U.S. Pat. Nos. 996,462, June 27, 1911 to Curtis and 1,196,703, Aug. 29, 1916 to Kraut teach wrenches having stationary and slidable jaws; and U.S. Pat. No. 2,371,003, Mar. 6, 1945 to Trinajstich discloses a holder for electric welding rods.

In the insertion and removal of contacts with respect to electrical connectors, several problems are often encountered. Because of the multiplicity of wires generally involved, it is difficult to hold the contact with conventional gripping tools employing a tweezer-type action, because pushing of the tweezer into the bundle of wires requires a grasping action which tends to open the jaws thereof and release the contact. Also, the tips of conventional contact insertion or removal tools are quite slender and are frequently damaged, thus necessitating frequent and unnecessarily expensive replacement of the entire tool.

Therefore, it is an object of the present invention to provide a contact insertion and removal tool which facilitates the holding or releasing of contacts in a crowded environment. It is a further object of this invention to provide a contact gripping tool having jaws which are held in a parallel configuration whether closed, partially open or fully open and which do not tend to open when inserted into an electrical connector. Still another object of this invention is to provide a contact gripping tool having jaws which are replaceable and hence, can be replaced when damaged without replacing the entire tool.

SUMMARY OF THE INVENTION

The present invention relates to a hand-operated contact insertion and removal tool especially adapted for inserting contacts into, or removing contacts from, electrical connectors. The tool comprises a movable member slidably carried within an elongated handle housing, the forward extremities of both the movable member and handle housing each having a jaw, and a means for moving said movable member. The movable member is under spring tension urging its jaw against the jaw of the elongated handle member. The jaws can be opened by moving the movable member rearward against the spring tension and the tool is designed so that such rearward movement can be accomplished by means of a thumb or finger. It is preferable that the jaws used for inserting a wire be shaped differently than those used for removing a wire.

The wire gripping tool of this invention can be made in such a manner as to have removable or replaceable jaws, thus minimizing the expense of damaged jaws. Further, the tool is designed in such a way as to facilitate the operation of the hand-operated movable jaw in a crowded environment.

DESCRIPTION OF THE INVENTION

Figures 1, 2, 3, 4, 5, 6, 7, 8, 9, 10:
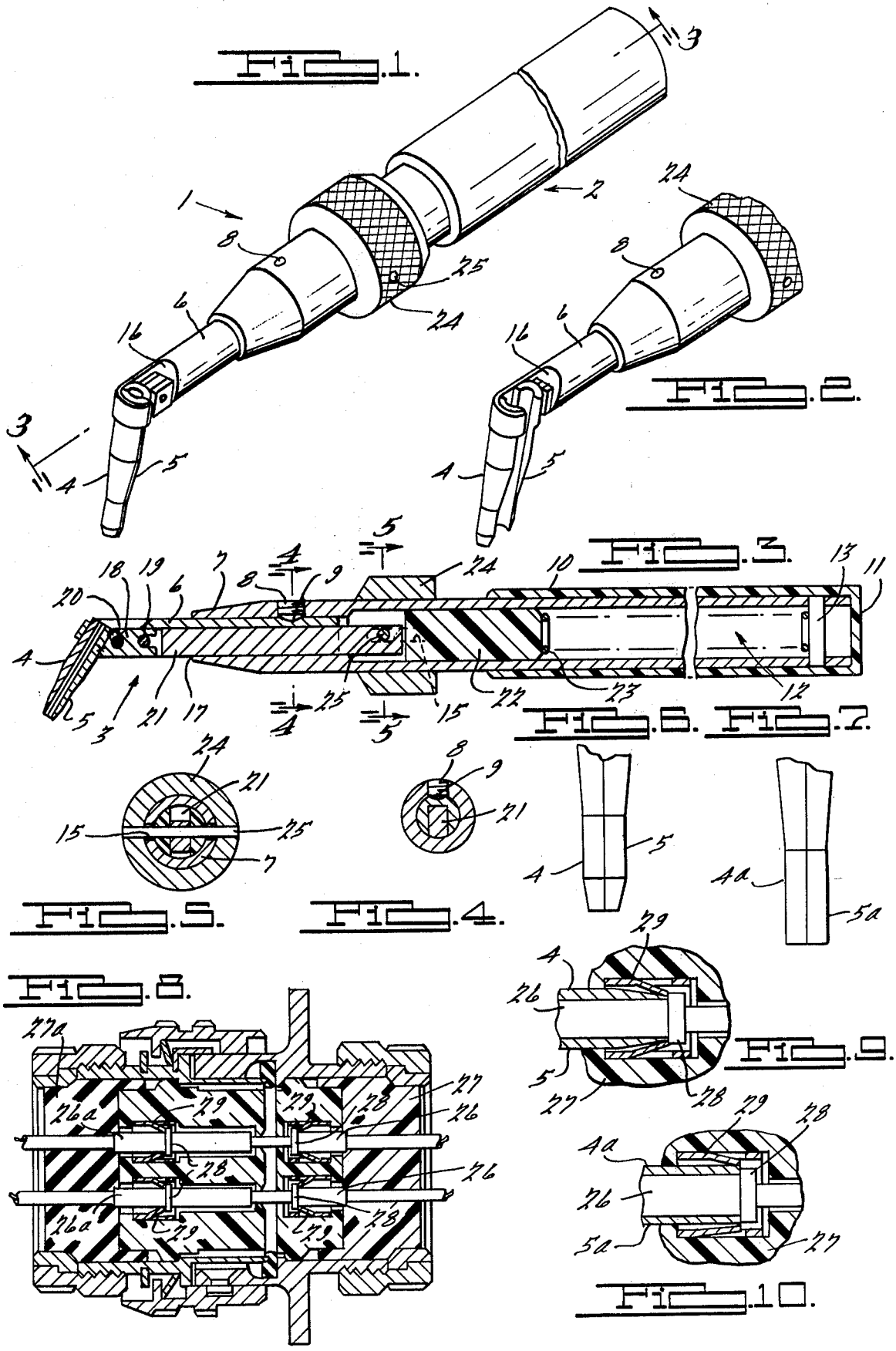
FIG. 1 is a perspective view, with parts broken away, illustrating a tool embodying the principles of the present invention with the jaws thereof in closed position.
FIG. 2 is a fragmentary view similar to that of FIG. 1 illustrating the jaws of the tool in an open position.
FIG. 3 is a longitudinal-sectional view of the tool taken along line 3—3 of FIG. 1 through a midplane of the tool.
FIG. 4 is a cross sectional view of the tool taken along line 4—4 of FIG. 3.
FIG. 5 is a cross-sectional view of the tool taken along line 5—5 of FIG. 3.
FIG. 6 is an enlarged fragmentary elevational view of contact insertion jaws for the present tool, shown in closed position.
FIG. 7 is an enlarged fragmentary elevational view of contact removal jaws for the present tool, shown in closed position.
FIG. 8 is a longitudinal sectional view of a conventional electrical connector with wires and contacts inserted therein.
FIG. 9 is a fragmentary longitudinal sectional view illustrating the jaws of the present tool inserting a contact into the connector of FIG. 8.
FIG. 10 is a fragmentary longitudinal sectional view illustrating the jaws of the present tool removing a contact from the connector of FIG. 8.

The tool 1 of the present invention generally comprises an elongated handle housing 2 slidably carrying a movable member 3, a pair of jaws 4 and 5 at the forward extremities thereof, and means for manually actuating movable member 3.

Elongated handle housing 2 comprises a tubular element 7 tapering at its forward extremity to facilitate the use of tool 1 in a crowded environment, and has a removable forward extension 6 mounted therein and secured by a set screw 8 which seats in a depression 9 in extension 6. Jaw 4 permanently affixed to extension 6 and together they form an easily replaceable stationary tip assembly. Forward extension 6 has a notch 16 therein to facilitate placement of a contact between jaws 4 and 5 and a rectangular channel 17 within which movable member 3 is slidably located. To facilitate hand-holding of tool 1 of this invention, tubular element 7 has a grip 10 having an end 11 which caps and protects a cavity 12 within tubular element 7.

Disposed within cavity 12 of tubular element 7 is a compression spring 23 which is compressed between a spring stop 13 and a movable plug 22. Spring 23 urges movable plug 22 forwardly against movable member 3, which comprises a slide 21 and a removable jaw mounting element 18 attached thereto by means of a guide pin 19 and a press fit lock pin 20. Slide 21 has a rectangular cross-section and slidably fits within channel 17, which has a correspondingly-shaped rectangular cross-section so as to prevent relative rotation of the parts. Slide 21 is connected to a collar 24, located at about the midpoint of the tool 1 where it can be easily thumb or finger operated, by a pin 25 which extends through a slot 15 in tubular element 7. Rearward movement of slide 21 in a jaw opening direction is limited by the rearward end of slot 15 acting on pin 25.

Welded or otherwise permanently affixed to the forward extremity of element 18 is jaw 5 which is opposed and in parallel relation to jaw 4. Mounting element 18 and jaw 5 together form an easily replaceable sliding tip assembly. Preferably, jaws 4 and 5 have opposing concave faces for gripping a contact, however, other face configurations such as a V-shape, may also be used, as will be apparent to those skilled in the art.

The operation of the tool of this invention can be readily visualized. Grip 10 of the tool is grasped in the hand in such a way that a finger or thumb is extended over collar 24 so as to be able to urge it rearwardly against the pressure exerted by spring 23. A rearward movement of collar 24 will urge movable member 3 rearward to open jaws 4 and 5 to permit insertion of a contact therebetween. Release of collar 24 causes the contact to be clamped by the jaws by the force of spring 23.

The operation of the tool of the present invention to insert or remove a contact from a connector will be readily apparent to those skilled in the art. A cross sectional view of a typical connector is illustrated in FIG. 8, showing pin insert contacts 26 which have been inserted through gasket 27, and socket insert contacts **26*a* which have been inserted through gasket 27*a*. As shown, each of the contacts is affixed in the usual manner to the end of an insulated wire, and each of the contacts is retained in place by engagement of fingers 29 in the connector with shoulders 28** on the contacts.

A pair of jaws characterized by tapered tips, as illustrated in FIG. 6, may be used to insert contacts into a connector. With reference to FIG. 9, it can be seen that once inserted, the tapered jaws 4 and 5 hold contact 26 but allow retention fingers 29 to engage the mounting shoulder 28 of contact 26.

FIG. 7 illustrates the design of jaws **4*a* and 5*a* corresponding to jaws 4 and 5 but having squared tips for use in removing contacts from connectors. As shown in FIG. 10, once inserted into the connector the tips of jaws 4*a* and 5*a* urge retention fingers 29 apart, permitting the removal of contact 26** from the connector.

In the event one or both of the jaws are damaged, replacement is easily accomplished by replacing either one or both of the tip assemblies.

While a specific form of the present invention has been described and illustrated herein, it is to be understood that the invention may be varied within the scope of the appended claims without departing from the spirit of the invention.

What is claimed is:

1. A manually operable tool for handling contacts in electrical connectors, comprising: an elongated handle housing having means for manually gripping and supporting the tool; a movable member longitudinally slidable in said housing; opposed parallel jaws affixed to the forward extremities of said member and said housing, respectively, said jaws having opposing, concave faces; spring means biasing said movable member with respect to said housing in a direction tending to close said jaws; and a collar surrounding said housing and being movable with respect thereto, said collar being connected to said movable member for manually moving said movable member relative to said housing.

2. A tool as recited in claim 1, wherein said collar is attached to said movable member by a pin slidable in a slot in said handle housing.

3. A tool as recited in claim 2, wherein said handle housing has a recess proximate the jaw attached thereto in which said forward extremity of said movable member is disposed.

4. A tool as recited in claim 3, wherein said handle housing comprises a tubular element having a forward extension removably mounted thereto, said forward extension supporting one of said jaws.

5. A tool as recited in claim 4, further comprising a cylindrical grip formed of resilient material covering said tubular element.

6. A tool as recited in claim 4, wherein said movable member has one of said jaws removably attached thereto.

7. A tool as recited in claim 6, wherein said spring means is disposed within said housing.

8. A manually operable tool for handling contacts in electrical connectors, comprising an elongated handle housing, a spring-loaded movable member longitudinally slidable in said housing, the forward extremity of said member and said housing having jaws in opposed parallel relationship attached thereto, and manually operable means comprising a collar surrounding said housing and being movable with respect thereto for moving said member relative to said housing, and said spring-loaded movable member being biased with respect to said housing in a direction tending to close said jaws.

9. A tool as recited in claim 8, wherein said jaws have opposing concave faces and are each respectively removably attached to said member and said forward extremity.

10. A manually operable tool for handling contacts in electrical connectors, comprising: a tubular element having a forward extension removably mounted thereto; a cylindrical grip formed of resilient material covering said tubular element; a movable member longitudinally slidable in said tubular element; opposed parallel jaws attached to said forward extension and said movable member, respectively, the jaw attached to said movable member being removably attached thereto, and said jaws being in the form of generally semicylindrical sleeves with opposing concave faces; spring means disposed in said tubular element and biasing said movable member with respect to said tubular element in a direction tending to close said jaws; and a collar surrounding said tubular element and movable with respect thereto, said collar being attached to said movable member by a pin slidable in a slot in said tubular element.

* * * * *